US006065568A

United States Patent [19]

Harder

[11] Patent Number: 6,065,568

[45] Date of Patent: May 23, 2000

[54] DRIVE-UP VENDING MACHINE

[76] Inventor: Richard D. Harder, S-8249 Inspiration Dr., Merrimac, Wis. 53561

[21] Appl. No.: 09/015,098

[22] Filed: Jan. 29, 1998

[51] Int. Cl.[7] ..... G07F 11/00

[52] U.S. Cl. ..... 186/53; 221/195

[58] Field of Search ..... 186/36, 37, 41, 186/53; 221/195, 196, 312 R

[56] References Cited

U.S. PATENT DOCUMENTS

| | | | |
|---|---|---|---|
| 5,217,088 | 6/1993 | Dallman | 186/37 |
| 5,482,139 | 1/1996 | Rivalto | 186/53 X |
| 5,499,707 | 3/1996 | Steury | 186/36 X |

FOREIGN PATENT DOCUMENTS

| | | | |
|---|---|---|---|
| 3-288991 | 12/1991 | Japan | 186/53 |
| 4-67286 | 3/1992 | Japan | 186/53 |

*Primary Examiner*—F. J. Bartuska

[57] ABSTRACT

A convenient and safe drive-up vending machine is provided including a housing with a front face, a rear face, a top surface, a bottom surface, and a pair of side faces formed therebetween defining an interior space. A dispensing chute is situated on the front face of the housing. Also included is a money exchanger situated on the front face of the housing. The money exchanger serves to accept and account for money in the form of bills and coins and further dispense change in the form of coins. A selection panel is situated on the front face of the housing and includes a plurality of buttons each having indicia indicative of a consumable product. The selection panel is adapted to effect the delivery of one of the consumable products upon the acceptance and accounting for a proper amount of money and subsequent depression of one of the buttons which correspond to one of the consumable products. Finally, a dispensing pan is coupled to the front face of the housing below the chute.

10 Claims, 2 Drawing Sheets

DRIVE-UP VENDING MACHINE

BACKGROUND OF THE INVENTION

1. Field of the Invention

The present invention relates to vending machines and more particularly pertains to a new convenient and safe drive-up vending machine for providing a convenient and safe drive-up vending machine for dispensing food or beverage products.

2. Description of the Prior Art

The use of vending machines is known in the prior art. More specifically, vending machines heretofore devised and utilized are known to consist basically of familiar, expected and obvious structural configurations, notwithstanding the myriad of designs encompassed by the crowded prior art which have been developed for the fulfillment of countless objectives and requirements.

Known prior art vending machines include U.S. Pat. No. 5,415,319; U.S. Pat. No. 4,042,146; U.S. Des. Pat. No. 354,083; U.S. Pat. No. 4,675,515; U.S. Pat. No. 4,111,282; and U.S. Des. Pat. No. 332,469.

In these respects, the convenient and safe drive-up vending machine according to the present invention substantially departs from the conventional concepts and designs of the prior art, and in so doing provides an apparatus primarily developed for the purpose of providing a drive up vending machine for dispensing food or beverage products.

SUMMARY OF THE INVENTION

In view of the foregoing disadvantages inherent in the known types of vending machines now present in the prior art, the present invention provides a new convenient and safe drive-up vending machine construction wherein the same can be utilized for providing a drive up vending machine for dispensing food or beverage products.

The general purpose of the present invention, which will be described subsequently in greater detail, is to provide a new convenient and safe drive-up vending machine apparatus and method which has many of the advantages of the vending machines mentioned heretofore and many novel features that result in a new convenient and safe drive-up vending machine which is not anticipated, rendered obvious, suggested, or even implied by any of the prior art vending machines, either alone or in any combination thereof.

To attain this, the present invention generally comprises a housing with a generally rectangular configuration. The housing has a front face, a rear face, a top surface, a bottom surface, and a pair of side faces formed therebetween defining an interior space. Next provided is a base comprising a concrete slab onto which the housing is mounted. It should be noted that a top face of the base has a surface area greater than that of the bottom face of the housing. This is important in order for a curb to be defined. Mounted within the base adjacent to the front face and one of the side faces of the housing is a vertically oriented cylindrical post. As best shown in FIGS. 3 & 4, a dispensing chute is situated on the front face of the housing at a central elevation thereof. Preferably, the dispensing chute is situated adjacent one of the side faces opposite that which is located adjacent the cylindrical post. The dispensing chute has a base plate coupled along an inboard edge thereof beneath an opening in the front face of the housing and extending forwardly and downwardly therefrom. Coupled to sides edges of the base plate are a pair side faces extending upwardly therefrom. Also included is a transparent dispensing pan having a vertical rear face and a bottom face integrally coupled to a bottom edge of the vertical rear face and extending forwardly and downwardly therefrom. Note FIGS. 3 & 4. The transparent dispensing pan further includes an arcuate front face and a pair of side face coupled between the front face, bottom face, and rear face for defining an interior space with an open top. So that the dispensing chute may be situated therethrough, the rear face of the dispensing pan has a rectangular cut out formed therein. The rear face is coupled to the front face of the housing via a plurality of springs. By this structure, the dispensing chute extends through the rectangular cutout and resides within the interior space thereof. Also included is a money exchanger. In use, the money exchanger serves to accept and account for money in the form of bills and coins and further dispense change in the form of coins. Associated therewith is a selection panel is situated on a central extent of the front face adjacent the dispensing chute. As shown in FIG. 2, the dispensing chute, money exchanger, and selection panel are all spaced at a common elevation in linear alignment. The selection panel includes a plurality of buttons each having indicia indicative of a food or beverage product. During operation, the selection panel effects the delivery of one of the food or beverage products via the dispensing chute and pan upon the acceptance and accounting for a proper amount of money and subsequent depression of one of the buttons which correspond to one of the food or beverage products.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new convenient and safe drive-up vending machine apparatus and method which has many of the advantages of the vending machines mentioned heretofore and many novel features that result in a new convenient and safe drive-up vending machine which is not anticipated, rendered obvious, suggested, or even implied by any of the prior art vending machines, either alone or in any combination thereof.

It is another object of the present invention to provide a new convenient and safe drive-up vending machine which may be easily and efficiently manufactured and marketed.

It is a further object of the present invention to provide a new convenient and safe drive-up vending machine which is of a durable and reliable construction.

An even further object of the present invention is to provide a new convenient and safe drive-up vending machine which is susceptible of a low cost of manufacture with regard to both materials and labor, and which accordingly is then susceptible of low prices of sale to the consuming public, thereby making such convenient and safe drive-up vending machine economically available to the buying public.

Still yet another object of the present invention is to provide a new convenient and safe drive-up vending machine which provides in the apparatuses and methods of the prior art some of the advantages thereof, while simultaneously overcoming some of the disadvantages normally associated therewith.

Still another object of the present invention is to provide a new convenient and safe drive-up vending machine for providing a drive up vending machine for dispensing food or beverage products.

Even still another object of the present invention is to provide a new convenient and safe drive-up vending machine that includes a housing with a front face, a rear face, a top surface, a bottom surface, and a pair of side faces formed therebetween defining an interior space. A dispensing chute is situated on the front face of the housing. Also included is a money exchanger situated on the front face of the housing. The money exchanger serves to accept and account for money in the form of bills and coins and further dispense change in the form of coins. A selection panel is situated on the front face of the housing and includes a plurality of buttons each having indicia indicative of a food or beverage product. The selection panel is adapted to effect the delivery of one of the food or beverage products upon the acceptance and accounting for a proper amount of money and subsequent depression of one of the buttons which correspond to one of the food or beverage products. Finally, a transparent dispensing pan is coupled to the front face of the housing below the chute.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
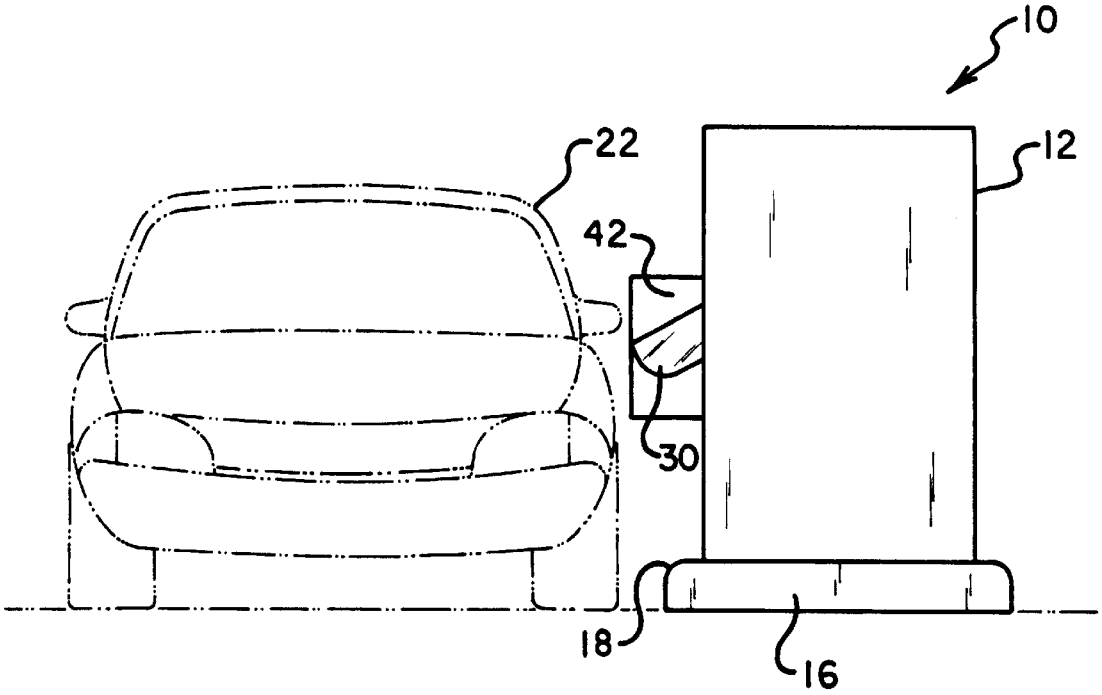
FIG. 1 is a side view of a new convenient and safe drive-up vending machine according to the present invention.

With reference now to the drawings, and in particular to FIGS. 1 through 4 thereof, a new convenient and safe drive-up vending machine embodying the principles and concepts of the present invention and generally designated by the reference numeral 10 will be described.

Figure 2:
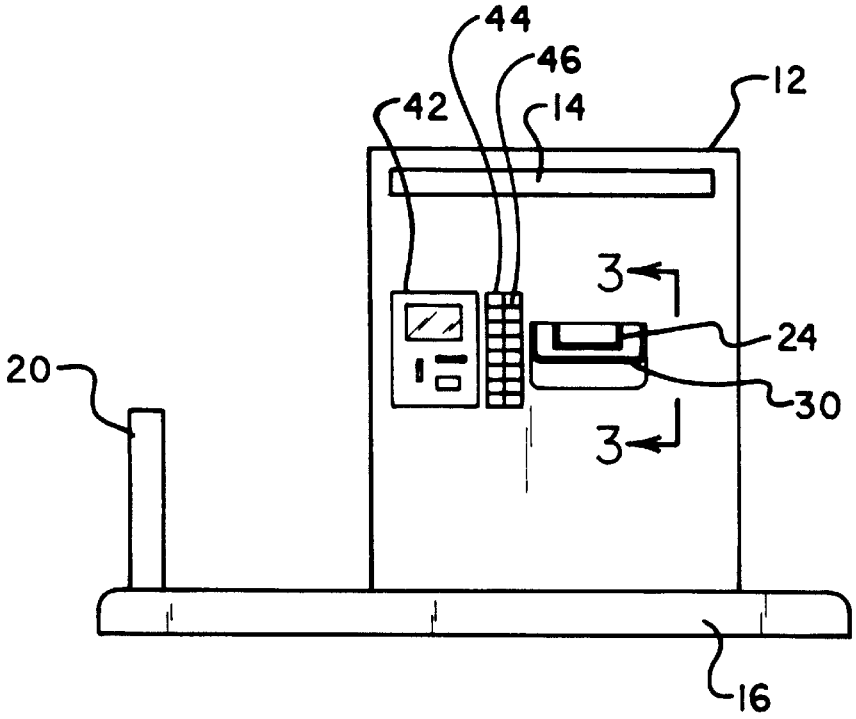
FIG. 2 is a front view of the present invention.

As shown in FIGS. 1 & 2, a housing 12 is provided with a generally rectangular configuration. The housing has a front face, a rear face, a top surface, a bottom surface, and a pair of side faces formed therebetween defining an interior space. In the preferred embodiment, the housing has a height and depth similar to that of a conventional soda pop vending machine. Also, a lighted transparent panel 14 is preferably located on the front face of the housing adjacent the top face thereof for advertising purposes and the like.

Next provided is a base 16 comprising a concrete slab onto which the housing is mounted. It should be noted that a top face of the base has a surface area greater than that of the bottom face of the housing. This is important in order for a curb 18 to be afforded.

Mounted within the base adjacent to the front face and one of the side faces of the housing is a vertically oriented cylindrical post 20. The post serves to prevent damage from being inflicted on the housing by a vehicle 22.

Figure 3:
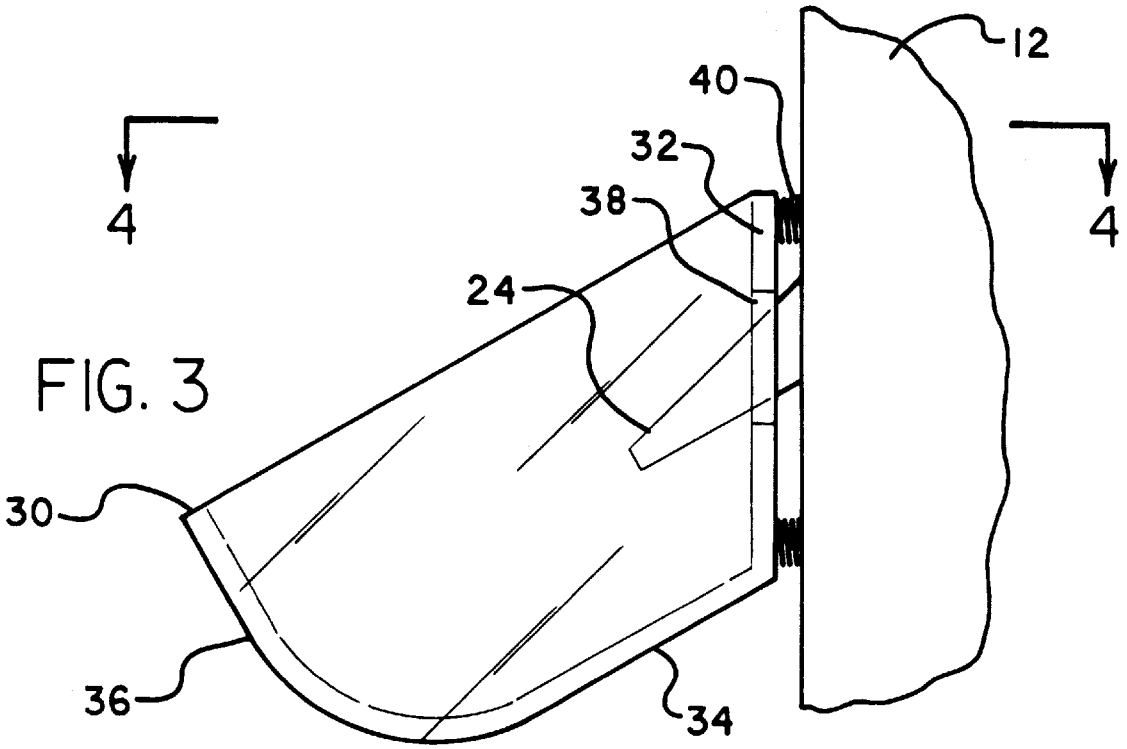
FIG. 3 is a close up side view of the dispensing pan and chute of the present invention.
Figure 4:
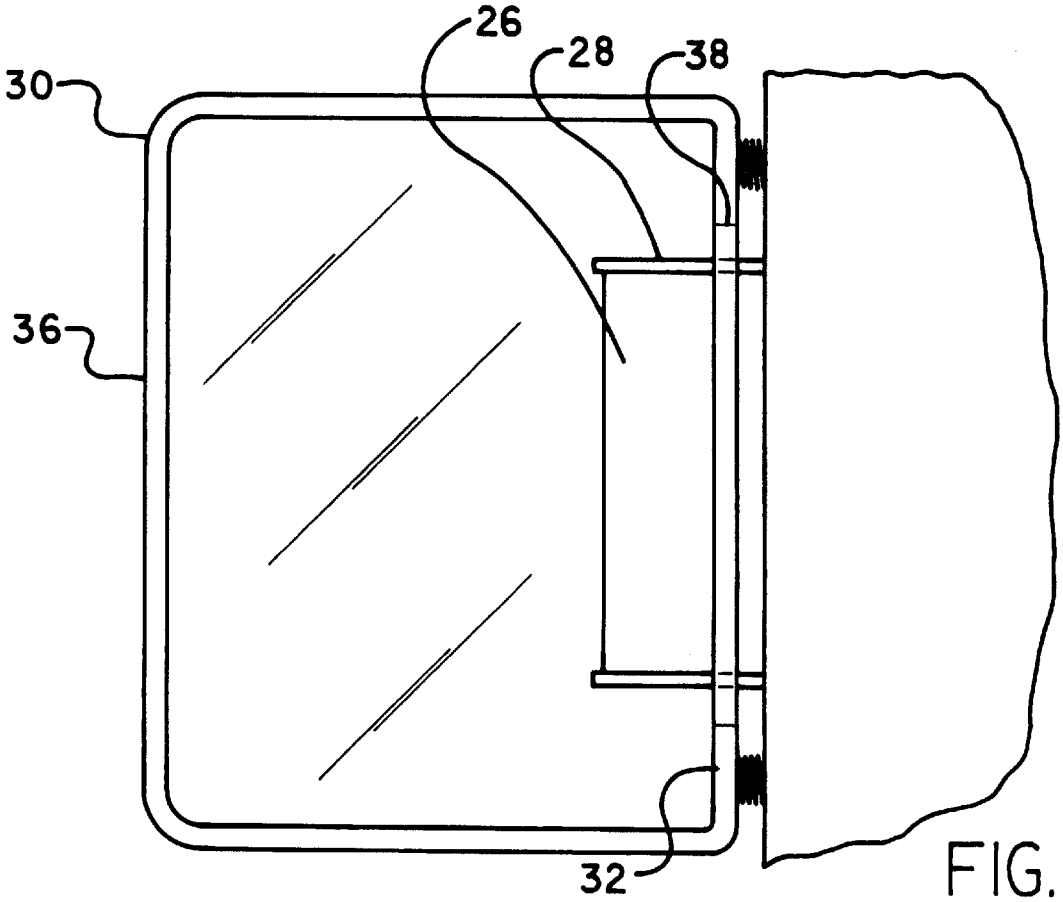
FIG. 4 is a close up top view of the dispensing pan and chute of the present invention.

As best shown in FIGS. 3 & 4, a dispensing chute 24 is situated on the front face of the housing at a central elevation thereof. Preferably, the dispensing chute is situated adjacent one of the side faces opposite that which is located adjacent the cylindrical post. The dispensing chute has a base plate 26 coupled along an inboard edge thereof beneath an opening in the front face of the housing and extended forwardly and downwardly therefrom. Coupled to sides edges of the base plate is a pair side faces 28 extending upwardly therefrom.

Also included is a transparent dispensing pan 30 having a vertical rear face 32 and a bottom face 34 integrally coupled to a bottom edge of the vertical rear face and extended forwardly and downwardly therefrom. Note FIGS. 3 & 4. The transparent dispensing pan further includes an arcuate front face 36 and a pair of side face coupled between the front face, bottom face, and rear face for defining an interior space with an open top. So that the dispensing chute may be situated therethrough, the rear face of the dispensing pan has a rectangular cut out 38 formed therein. The rear face is coupled to the front face of the housing via a plurality of springs 40. By this structure, the dispensing chute extends through the rectangular cutout and resides within the interior space thereof. In use, after being struck by a vehicle, the dispensing chute is adapted to return to its normal position.

In the alternative, the dispensing pan may be adapted to be slidably situated within the housing. In use, the dispensing pan is adapted to automatically extend outwards upon the dispensing of an item. In yet another alternate embodiment, the dispensing pan is constructed of metal such as aluminum or the like.

A money exchanger 42 is situated on the front face of the housing at a central elevation thereof adjacent the side face which is located adjacent the cylindrical post. In use, the money exchanger serves to accept and account for money in the form of bills and coins and further dispense change in the form of coins. A front face of the money exchanger preferably extends a distance equal to that which the dispensing chute and other mechanical components of the present invention extend to afford a more conveniently accessible device. In the alternative, the front face of the money exchanger may be recessed depending on the specific needs of the user.

Situated on a central extent of the front face adjacent the dispensing chute is a selection panel 44. The elevation of the dispensing chute is preferably the height of a vehicle window. As shown in FIG. 2, the dispensing chute, money exchanger, and selection panel are all spaced at a common elevation in linear alignment. A front face of the selection panel ideally extends a distance from the front face of the housing a distance equal to that which the dispensing chute or money exchanger extends.

The selection panel includes a plurality of buttons, designated as numeral 46, each having indicia indicative of a food or beverage product. It should be noted that the beverage product may consist of soda pop, juice or any other contained liquid. During operation, the selection panel effects the delivery of one of the food or beverage products via the dispensing chute and pan upon the acceptance and accounting for a proper amount of money and subsequent depression of one of the buttons which correspond to one of the food or beverage products, as is common in the art of vending machines. The dispensing pan precludes the food or beverage product from being projected to the ground and further affords a user convenient access thereto. As an option, a large rectangular padded bumper may be situated on the front face of the housing below the dispensing pan, money exchanger, and selection panel for protecting the housing from damage.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A convenient and safe drive-up vending machine comprising, in combination:

a housing with a generally rectangular configuration with a front face, a rear face, a top surface, a bottom surface, and a pair of side faces formed therebetween defining an interior space, a base comprising a concrete slab onto which the housing is mounted, wherein a top face of the base has a surface area greater than that of the bottom face of the housing thereby defining a curb;

a vertically oriented cylindrical post having a bottom end mounted within the base adjacent to the front face and one of the side faces of the housing;

a dispensing chute situated on the front face of the housing at a central elevation thereof adjacent one of the side faces opposite that which is located adjacent the cylindrical post, the dispensing chute having a base plate coupled along an inboard edge thereof beneath an opening in the front face of the housing and extending forwardly and downwardly therefrom and a pair side faces coupled to sides edges of the base plate and extending upwardly therefrom;

a transparent dispensing pan having a vertical rear face, a bottom face integrally coupled to a bottom edge of the vertical rear face and extending forwardly and downwardly therefrom, an arcuate front face, and a pair of side face coupled between the front face, bottom face, and rear face for defining an interior space with an open top, the rear face having a rectangular cut out formed therein, the rear face coupled to the front face of the housing via a plurality of springs whereby the dispensing chute extends through the rectangular cutout and resides within the interior space thereof;

a money exchanger situated on the front face at a central elevation thereof adjacent the side face which is located adjacent the cylindrical post, the money exchanger adapted to accept and account for money in the form of bills and coins and further dispense change in the form of coins; and a selection panel situated on a central extent of the front face adjacent the dispensing chute, the selection panel including a plurality of buttons each having indicia indicative of a consumable product, the selection panel adapted to effecting the delivery of one of the consumable products via the dispensing chute and pan upon the acceptance and accounting for a proper amount of money and subsequent depression of one of the buttons which correspond to one of the consumable products;

said dispensing chute, money exchanger, and selection panel all being spaced at a common elevation in linear alignment.

2. A convenient and safe drive-up vending machine comprising:

a housing with a front face, a rear face, a top surface, a bottom surface, and a pair of side faces formed therebetween defining an interior space;

a dispensing chute situated at a central elevation of the front face of the housing adjacent one of the side faces;

a dispensing pan coupled to the front face of the housing with a plurality of springs coupled therebetween;

a money exchanger situated at a central elevation of the front face of the housing and adapted to accept and account for money in the form of bills and coins and further dispense change in the form of coins; and a selection panel situated at a central elevation of the front face of the housing, the selection panel including a plurality of buttons each having indicia indicative of a consumable product, the selection panel adapted to effect the delivery of one of the consumable products upon the acceptance and accounting for a proper amount of money and subsequent depression of one of the buttons which correspond to one of the consumable products;

said dispensing chute, money exchanger, and selection panel all being spaced at a common elevation in linear alignment.

3. The convenient and safe drive-up vending machine as set forth in claim 2 and further including a base comprising a concrete slab onto which the housing is mounted, wherein a top face of the base has a surface area greater than that of the bottom face of the housing thereby defining a curb.

4. The convenient and safe drive-up vending machine as set forth in claim 2 and further including a vertically oriented cylindrical post having a bottom end mounted adjacent to the front face and one of the side faces of the housing.

5. The convenient and safe drive-up vending machine as set forth in claim 4 wherein the cylindrical post is mounted adjacent one of the side faces which is opposite to the side face adjacent to which the dispensing chute is positioned.

6. The convenient and safe drive-up vending machine as set forth in claim 2 and further including a dispensing pan coupled to the front face of the housing below the dispensing chute.

7. The convenient and safe drive-up vending machine as set forth in claim 6 wherein the dispensing pan includes a vertical rear face, a bottom face integrally coupled to a bottom edge of the vertical rear face and extending forwardly and downwardly therefrom, an arcuate front face, and a pair of side face coupled between the front face, bottom face, and rear face for defining an interior space with an open top, the rear face having a rectangular cut out formed therein, whereby the dispensing chute extends through the rectangular cutout and resides within the interior space thereof.

8. The convenient and safe drive-up vending machine as set forth in claim 2 wherein the consumable product is a food product.

9. The convenient and safe drive-up vending machine as set forth in claim 2 wherein the consumable product is a beverage product.

10. A convenient and safe drive-up vending machine comprising:

a housing with a front face, a rear face, a top surface, a bottom surface, and a pair of side faces formed therebetween defining an interior space;

a dispensing chute situated on the front face of the housing;

a money exchanger situated on the front face of the housing, the money exchanger adapted to accept and account for money in the form of bills and coins and further dispense change in the form of coins;

a selection panel situated on the front face of the housing, the selection panel including a plurality of buttons each having indicia indicative of a consumable product, the selection panel adapted to effect the delivery of one of the consumable products upon the acceptance and accounting for a proper amount of money and subsequent depression of one of the buttons which correspond to one of the consumable products; and a dispensing pan coupled to the front face of the housing below the chute, at least one spring being coupled between the housing and the dispensing pan.

* * * * *